US009713387B2

(12) United States Patent
Hille

(10) Patent No.: US 9,713,387 B2
(45) Date of Patent: Jul. 25, 2017

(54) ELECTROMOTIVE FURNITURE DRIVE FOR A PIECE OF FURNITURE, A METHOD FOR MONITORING A PULSE-WIDTH RATIO OF AN ELECTROMOTIVE FURNITURE DRIVE, AND A CORRESPONDING PIECE OF FURNITURE

(71) Applicant: DEWERTOKIN GMBH, Kirchlengern (DE)

(72) Inventor: Armin Hille, Bielefeld (DE)

(73) Assignee: DEWERTOKIN GMBH, Kirchlengern (DE)

( * ) Notice: Subject to any disclaimer, the term of this patent is extended or adjusted under 35 U.S.C. 154(b) by 0 days.

(21) Appl. No.: 14/381,843

(22) PCT Filed: Feb. 28, 2013

(86) PCT No.: PCT/EP2013/054072
§ 371 (c)(1),
(2) Date: Aug. 28, 2014

(87) PCT Pub. No.: WO2013/127940
PCT Pub. Date: Sep. 6, 2013

(65) Prior Publication Data

US 2015/0048763 A1 Feb. 19, 2015

(30) Foreign Application Priority Data

Feb. 28, 2012 (DE) ..... 10 2012 101 622

(51) Int. Cl.
*G05D 1/02* (2006.01)
*H04Q 9/00* (2006.01)
(Continued)

(52) U.S. Cl.
CPC ..... *A47C 17/04* (2013.01); *A47C 7/62* (2013.01); *A47C 17/86* (2013.01); *A47C 20/041* (2013.01); *A47C 31/008* (2013.01)

(58) Field of Classification Search
CPC .... H02M 2001/0006; H02M 2001/008; H02P 21/0025; H02P 23/0031; H02P 25/021;
(Continued)

(56) References Cited

U.S. PATENT DOCUMENTS 3,628,112 A * 12/1971 Gross ..... H02P 3/22 318/258
4,096,421 A * 6/1978 Farber ..... B30B 9/3007 318/258
(Continued)

FOREIGN PATENT DOCUMENTS

CN 1413093 A 4/2003
DE 27 36 276 B1 11/1978
(Continued)

*Primary Examiner* — Paul Ip
(74) *Attorney, Agent, or Firm* — Henry M. Feiereisen LLC

(57) ABSTRACT

The invention relates to an electromotive furniture drive (100) for adjusting a movable part (4, 5) of a piece of furniture (1) by means of an output element, comprising a) at least one adjusting drive (7, 8) with respectively at least one electric motor, a speed reducing mechanism which is coupled thereto and which ensures that the output element is drivenly coupled and can be linearly displaced and/or rotatably moved, and when said output element reaches a predetermined position, said output element actuates an end switch and/or reference switch and/or switching means, b) at least one control device (9) and c) at least one control unit (10), said control device (9) comprising a positioning device for the output element provided with a control block with a counter and a recording device for evaluating impulses of a counter EMK of the at least one electric motor. Said control
(Continued)

device (9) comprises a digital potentiometer which emits as an output value, an electric value which is proportionate to the position of said output element. The control device comprises, in a further embodiment, a monitoring device. The invention also relates to a method for monitoring a pulse width ratio of an electromotive furniture drive and a piece of furniture (1).

27 Claims, 8 Drawing Sheets

(51) Int. Cl.

| | |
|---|---|
| ***A47C 17/04*** | (2006.01) |
| ***A47C 20/04*** | (2006.01) |
| ***A47C 31/00*** | (2006.01) |
| ***A47C 7/62*** | (2006.01) |
| ***A47C 17/86*** | (2006.01) |

(58) Field of Classification Search

CPC .... H02P 5/50; H02P 6/002; H02P 6/06; H02P 6/18; H02P 6/182; H02P 6/20; H02P 6/22; H02P 6/24; H02P 7/0044; H02P 7/292

USPC ..... 318/16, 430, 618, 400.11; 5/713, 630; 297/362.11; 700/275

See application file for complete search history.

(56) References Cited

U.S. PATENT DOCUMENTS 4,144,482 A * 3/1979 Schwab ..... H02P 3/06 318/375
4,250,439 A 2/1981 Hohmann
4,296,361 A * 10/1981 Archer ..... B62D 11/04 318/54
4,396,877 A * 8/1983 Egri ..... H05B 7/144 318/258
4,458,183 A * 7/1984 Neilson ..... H02P 7/2913 318/139
4,489,257 A * 12/1984 Lindow ..... H02P 7/281 318/258
4,581,565 A * 4/1986 Van Pelt ..... H02P 7/04 318/294
4,591,014 A * 5/1986 Yasuda ..... B62D 5/0481 180/446
4,706,726 A * 11/1987 Nortoft ..... E06B 9/32 160/168.1 P
5,311,108 A * 5/1994 Willard ..... H02P 3/12 318/246
5,449,992 A * 9/1995 Geiger ..... H01H 21/10 318/362
5,814,955 A * 9/1998 Bauer ..... H02H 7/09 318/376
6,396,224 B1 * 5/2002 Luff ..... A47C 20/048 318/16
6,754,922 B2 6/2004 Dewert
6,841,953 B2 * 1/2005 Bastholm ..... H02P 5/50 318/105
6,978,501 B2 * 12/2005 Vrzalik ..... A61G 7/015 5/610
7,026,776 B1 * 4/2006 Walters ..... H02P 6/182 318/430
7,250,733 B2 * 7/2007 De Filippis ..... H02P 6/182 318/400.01
7,426,760 B2 * 9/2008 Vrzalik ..... A61G 7/015 5/425
7,465,280 B2 * 12/2008 Rawls-Meehan .... A47C 20/041 5/618
7,477,028 B2 * 1/2009 Bokusky ..... H02P 29/032 318/273
7,511,442 B2 * 3/2009 Jehle ..... G01R 31/34 318/282
7,810,188 B2 * 10/2010 Barthelt ..... A47C 19/045 5/11
7,827,632 B2 * 11/2010 Vrzalik ..... A61G 7/015 5/424
7,861,340 B2 * 1/2011 Barthelt ..... A61G 7/012 5/600
7,926,131 B2 * 4/2011 Menkedick ..... A61G 7/005 5/600
8,022,652 B2 * 9/2011 Fich ..... H02P 5/68 318/443
8,072,181 B2 * 12/2011 Koch ..... H02P 7/292 318/445
8,151,387 B2 * 4/2012 Osborne ..... A61G 7/005 5/610
8,541,963 B2 * 9/2013 Rottmerhusen ..... H02P 3/22 318/273
8,926,535 B2 * 1/2015 Rawls-Meehan .... A47C 20/041 5/617
2003/0079289 A1 * 5/2003 Vrzalik ..... A61G 7/015 5/618
2003/0102835 A1 * 6/2003 Castro ..... B60S 1/08 318/443
2003/0117094 A1 * 6/2003 Bastholm ..... H02P 5/50 318/34
2004/0251860 A1 * 12/2004 Ehsani ..... H02P 6/06 318/400.01
2005/0077869 A1 4/2005 Nagaoka
2006/0090261 A1 * 5/2006 Vrzalik ..... A61G 7/015 5/624
2006/0244406 A1 * 11/2006 Jehle ..... G01R 31/343 318/466
2007/0040520 A1 * 2/2007 De Filippis ..... H02P 6/182 318/400.04
2007/0157385 A1 * 7/2007 Lemire ..... A61G 7/005 5/600
2007/0163043 A1 * 7/2007 Lemire ..... A61G 7/005 5/600
2007/0169268 A1 * 7/2007 Lemire ..... A61G 7/005 5/617
2007/0174964 A1 * 8/2007 Lemire ..... A61G 7/005 5/600
2007/0174968 A1 * 8/2007 Barthelt ..... A47C 19/045 5/618
2007/0176758 A1 * 8/2007 Bokusky ..... H02P 29/032 340/425.5
2008/0009989 A1 * 1/2008 Kim ..... B60N 2/0232 701/36
2008/0148485 A1 * 6/2008 Barthelt ..... A61G 7/012 5/611
2008/0246422 A1 * 10/2008 Fich ..... H02P 5/68 318/85
2008/0255734 A1 * 10/2008 Altshuller ..... B60N 2/0244 701/49
2008/0262657 A1 * 10/2008 Howell ..... A47C 20/041 700/275
2008/0271246 A1 * 11/2008 Nielsen ..... A47C 20/041 5/616
2008/0289107 A1 * 11/2008 Vrzalik ..... A61G 7/015 5/601
2009/0012634 A1 * 1/2009 Koch ..... A47C 20/041 700/90
2009/0038074 A1 * 2/2009 Barthelt ..... A61G 7/012 5/611
2009/0139029 A1 6/2009 Rawls-Meehan
2009/0185403 A1 * 7/2009 Koch ..... H02P 7/292 363/126
2011/0316456 A1 * 12/2011 Rottmerhusen ..... H02P 25/14 318/381
2012/0060290 A1 * 3/2012 Jones ..... A61G 13/0018 5/611
2012/0062011 A1 * 3/2012 Jones ..... A61G 15/02 297/362.11

(56) References Cited

U.S. PATENT DOCUMENTS

| | | | |
|---|---|---|---|
| 2012/0194106 | A1 | 8/2012 | Hille |
| 2012/0206070 | A1 | 8/2012 | Hille |

FOREIGN PATENT DOCUMENTS

| | | | |
|---|---|---|---|
| DE | 10 2009 049 267 | A1 | 4/2011 |
| EP | 1 524 759 | A2 | 4/2005 |
| JP | 2003 325590 | A | 11/2003 |

* cited by examiner

ELECTROMOTIVE FURNITURE DRIVE FOR A PIECE OF FURNITURE, A METHOD FOR MONITORING A PULSE-WIDTH RATIO OF AN ELECTROMOTIVE FURNITURE DRIVE, AND A CORRESPONDING PIECE OF FURNITURE

CROSS-REFERENCES TO RELATED APPLICATIONS

This application is the U.S. National Stage of International Application No. PCT/2013/054072, filed Feb. 28, 2013, which designated the United States and has been published as International Publication No. WO 20131127940 and which claims the priority of German Patent Application, Serial No. 10 2012 101 622.4, filed Feb. 28, 2012, pursuant to 35 U.S.C. 119(a)-(d).

BACKGROUND OF THE INVENTION

The invention relates to an electromotive furniture drive for a piece of furniture. The invention also relates to a method for monitoring a pulse-width ratio of an electromotive furniture drive. The invention also relates to a corresponding piece of furniture.

Furniture with several supporting surfaces for supporting a person situated on the piece of furniture is widely known and used as beds, sofas, chairs and the like. These pieces of furniture comprise at least one movable supporting surface which is movably mounted relative to at least one further supporting surface. The movable supporting surface is a backrest part and/or a leg part which is adjustable by means of at least one electromotive furniture drive. For this purpose, the movable supporting surface can be pivotable, displaceable or both by means of a suitable fitting. It is also possible that a base element such as a bed frame is arranged in a height-adjustable fashion with one or several furniture drives.

An electromotive furniture drive comprises at least one electric motor, which is frequently arranged as a commutator DC motor. The motor is provided downstream with a gear, wherein usually a DC gear motor is used. The electromotive furniture drive further comprises an operating unit and a control unit. The operating unit can be arranged in a wire-bound or wireless manner and comprise a number of push-buttons, which upon actuation supply via signal transmission a control signal for electrically triggering the respective motor in the respective direction of rotation.

Various solutions have been provided for positioning an output element of the electromotive furniture drive. In one of these solutions, the control unit comprises a counter for counting pulse signals of a respective motor. The pulses are added in a first direction of rotation, and subtracted in a second direction of rotation. So-called memory control units are used for the repeated setting of a previously determinable position. The previously determinable position can be stored by the user and repeatedly retrieved again (i.e. set again).

Motors with Hall sensors, reed contacts and light barriers as pulse generators are known. Hall sensors are expensive and difficult to mount, e.g. their signal generators (magnets) are complex to mount separately from the Hall sensors which are arranged on separate circuit boards. Two Hall sensors are required for the reliable recognition of the direction of rotation. Cabling with multi-core cables (e.g. five-core motor cable) is necessary. The control unit requires the use of a microprocessor or microcomputer. Existing furniture without a memory control unit cannot be retrofitted or only with difficulty.

The document DE 10 2009 049 267 A1 describes a method and an apparatus for positioning an output element of an electromotive drive, especially for a piece of furniture. In this process, the pulses of a back-EMF of a respective electric motor are detected and evaluated.

SUMMARY OF THE INVENTION

It is the object of the present invention to provide an improved electromotive drive.

It is a further object to provide an improved method.

It is an even further object is to provide an improved piece of furniture.

An electromotive furniture drive is provided whose control device comprises a digital potentiometer in simple configuration for memory control and synchronous controls.

According to one aspect of the invention, the object is achieved by an electromotive furniture drive for adjusting a movable part of a piece of furniture by means of an output element, comprising a) at least one adjusting drive with respectively at least one electric motor, a revolution speed reducing gear mechanism which is coupled thereto and which ensures that the output element is drivingly coupled and can be linearly displaced and/or rotatably moved, wherein the output element, upon reaching a predetermined position, actuates an end switch and/or a reference switch and/or a switching means, b) at least one control device, and c) at least one operating unit, wherein the control device comprises a positioning apparatus for the output element having a control block with a counter and a memory device for evaluating pulses of a back-EMF of the at least one electric motor. At least one monitoring apparatus is provided for monitoring a pulse-width ratio of a detected back-EMF of the at least one electric motor.

The reliability of the electromotive furniture drive is improved in a simple manner by means of such a monitoring apparatus.

It is provided in one embodiment that the monitoring apparatus comprises at least one filter unit with a pulse former, and a load-monitoring device with a pulse-width ratio detector, a comparator and a signal generator. It has been noticed that under high loads of the electric motor the pulse-width ratio of the ripples of the back-EMF changes in a specific manner. These changes can advantageously be recognized by the monitoring apparatus. Countermeasures can be taken which improve reliability and reduce the error rate.

It is advantageous if the pulse former is a square-wave pulse former, thus always ensuring a defined pulse.

In a further embodiment, the pulse-width ratio detector is arranged for detecting the pulse-width ratio of the detected counter-EMF of the at least one electric motor. This can be arranged for example by means of simple electronic components which can be obtained at low cost and in high-quality on the market.

In a further embodiment, the comparator is arranged for comparing the detected pulse-width ratio with a previously determinable value. Following measurements and examinations, a critical value is a pulse-width ratio of 10/90. It is advantageous if the previously determinable value corresponds to a pulse-width ratio of 10/90.

It is further provided that the signal generator is arranged for generating a signal for the control of the motor for throttling the motor. Simple and effective countermeasures can thus be taken in that less power is supplied to each motor when a critical value of the pulse-width ratio is reached. Furthermore, the motor is protected by the throttling under high loads.

In another embodiment, the monitoring apparatus comprises at least one return-motion monitoring device, which is coupled to the output of the filter unit. It can thus be determined by the same measuring arrangement whether the motor is twisted in the deactivated short-circuited state under a potential external mechanical load.

It is provided for this purpose that the return-motion monitoring device is arranged for recognizing a rotation of a motor shaft of the motor in the short-circuited and deactivated state of the motor and for signaling such recognition. It is thus possible in a simple way to recognize twisting of the motor shaft and thus a change in the positioning by external mechanical influences. Respective corrections can be performed, e.g. resetting of the output element to a specific defined position.

It is provided in another embodiment that the monitoring apparatus is equipped with and connected to at least one energy storage unit, preferably a chargeable battery or a capacitor of high capacitance. As a result, the part of the electric circuit of the positioning apparatus for detecting, evaluating and counting the ripples can be operated in the currentless state at least for a specific interval by means of the energy storage unit.

It is advantageous for this purpose that a storage capacity of the energy storage unit is arranged in such a way that the part of the electric circuit of the positioning apparatus for detecting, evaluating and counting the ripples can be operated in the currentless state at least for a specific time interval by means of the energy storage unit.

In another embodiment, the at least one electric motor is equipped for smooth start-up with at least one bridgeable series resistor. As a result, potential disturbances in the detection of the back-EMF by a PWM control unit in other embodiments according to the state of the art are excluded in a simple way. It is especially advantageous if this resistor (or a part of it) is used simultaneously as a measuring resistor for the back-EMF.

In a further embodiment, the control device can comprise a digital potentiometer which emits as an output value an electric value which is proportionate to the position of said output element.

It is especially advantageous that a standard motor cable (two leads) with a standard plug-in connector (two-pole) can be used in the control unit. As a result, no change is necessary when using a standard motor.

In one embodiment, the digital potentiometer comprises at least one buffer memory unit and at least one digital-to-analog converter, wherein the buffer memory unit is provided for intermediately storing count values of the counter, and wherein the digital-to-analog converter converts the count values which are intermediately stored in the buffer memory unit into an analog output value. This allows a simple configuration of the digital potentiometer. Already existing free storage capacities of a memory device can be used as the buffer memory unit. It is also possible to arrange the digital-to-analog converter by means of software with the existing microprocessor(s), thus ensuring that space is saved.

The analog output value converted by the digital-to-analog converter is a voltage value and/or a current value which is simple to process further. Furniture drives with a potentiometer installed as a travel sensor can thus advantageously be used, which is reflected for example in very simple mounting. The output signal of the digital-to-analog converter is virtually identical with the analog voltage output of a potentiometer in furniture drives according to the state of the art.

Furthermore, the analog output value converted by the digital-to-analog converter can lie within a predetermined voltage or current interval, e.g. 0 to 5 V or 5 to 20 mA, wherein a minimum value corresponds to a first end position state of the output element and a maximum value corresponds to a second end position state of the output element.

The buffer memory unit can be arranged as a rewritable volatile or non-volatile memory. As a result, many configurations of buffer memory units can be used.

In another embodiment, at least one of the end switches, upon actuation in an end position of the output element, is provided for controlling the interruption in the power supply to the motor, for controlling the short-circuiting of the motor and for controlling the new setting of a reference point for the control unit or for positioning the output element. This allows a reliable deactivation on the one hand and a defined state of the motor, namely with rheostatic braking, in the off-state.

In a further embodiment, at least one end switch is arranged as a reference switch in the movement region of the output element at a previously determined position and is provided for controlling the new setting of a reference point for the control unit or for positioning the output element. As a result, an error rate in the repeat accuracy can thus be reduced considerably.

The relevant difference from furniture drives of the state of the art with pulse generators such as motors with Hall sensors will be explained here, wherein motors with Hall sensors require several motors with synchronizations among each other for precise positioning in high-quality height-adjustable tables for example. Such furniture drives with synchronizations are very complex and expensive. The embodiment according to the present invention lays the foundation for an alternative of the synchronizations and the positioning precision with high quality, but it is very simple in its configuration and offers a quality of the positioning precision which only close to similar. Tests have shown however that the embodiment and the method of the present invention has proven to be highly reliable, wherein a very high level of positioning quality is reached, which can be regarded as fully sufficient in the described pieces of furniture.

According to another aspect of the invention, the object is achieved by a method for monitoring a pulse-width ratio of the electromotive furniture drive as described above, comprising the following method steps:

(V1) detection of pulses of a back-EMF of the at least one electric motor (M1) of the electromotive furniture drive by measuring a voltage drop in a resistor or a specific resistance of a transistor;

(V2) detection of a pulse-width ratio of ripples of the thus detected back-EMF of the at least one electric motor;

(V3) comparison of the thus detected pulse-width ratio with a previously determinable value, and (V4) monitoring of the pulse-width ratio by evaluating the comparison obtained in this manner.

It is advantageously easily possible to monitor the pulse-width ratio, wherein simultaneously present parts (measuring resistor, filter unit) of the positioning device can be used.

It is advantageous if in the method step (V1) the detected pulses can be converted into square-wave pulses, because they have a defined shape and can be processed easily.

In accordance with the performed examinations and measured values, it is advantageous if the previously determinable value for comparison in the method step (V3) corresponds to a pulse-width ratio of 10/90.

It is provided in an embodiment that in the method step (V4), when the value drops beneath a critical comparative value, a throttling of the at least one electric motor occurs in operation. This can be implemented by simple measures, e.g. respective control signals, by intervention in the motor control unit, in that at least one series resistor is connected in series with the motor, as mentioned above.

It is further provided that in the method step (V3) a frequency of the ripples is monitored and in the method step (V4) a signal is generated that a case of jamming or overloading has occurred. Additional monitoring can be provided in this way.

According to another aspect of the invention, the object is achieved by a piece of furniture, comprising a) at least one base element for coupling the piece of furniture to an installation site, and b) at least one support element which comprises a part which is movably arranged relative to the support element or relative to a further support element or relative to the base element, c) wherein the at least one movably arranged part is arranged to be displaceable and/or pivotable, d) wherein the piece of furniture comprises at least one eletromechanical furniture drive, e) wherein the at least one movably arranged part is coupled to the at least one electromechanical furniture drive, and comprises the aforementioned electromotive furniture drive.

In a further embodiment, the control device comprises a memory control unit. Simple retrofitting and simple configuration with conventional adjusting drives can be provided by using the electromotive furniture drive with the digital potentiometer.

It is thus also advantageously possible in a simple way that the control device comprises a synchronous control unit, wherein the adjusting speeds of the at least two electromotive furniture drives are adjusted with respect to each other, especially positioned equally with respect to each other.

This provides both a memory control unit and synchronous control unit which can be inserted into any piece of furniture and which are connectable to any electromotive furniture drive inserted into the piece of furniture.

BRIEF DESCRIPTION OF THE DRAWING

The invention will be explained below in closer detail by reference to the enclosed drawings, wherein.

DETAILED DESCRIPTION OF PREFERRED EMBODIMENTS

Figure 1:
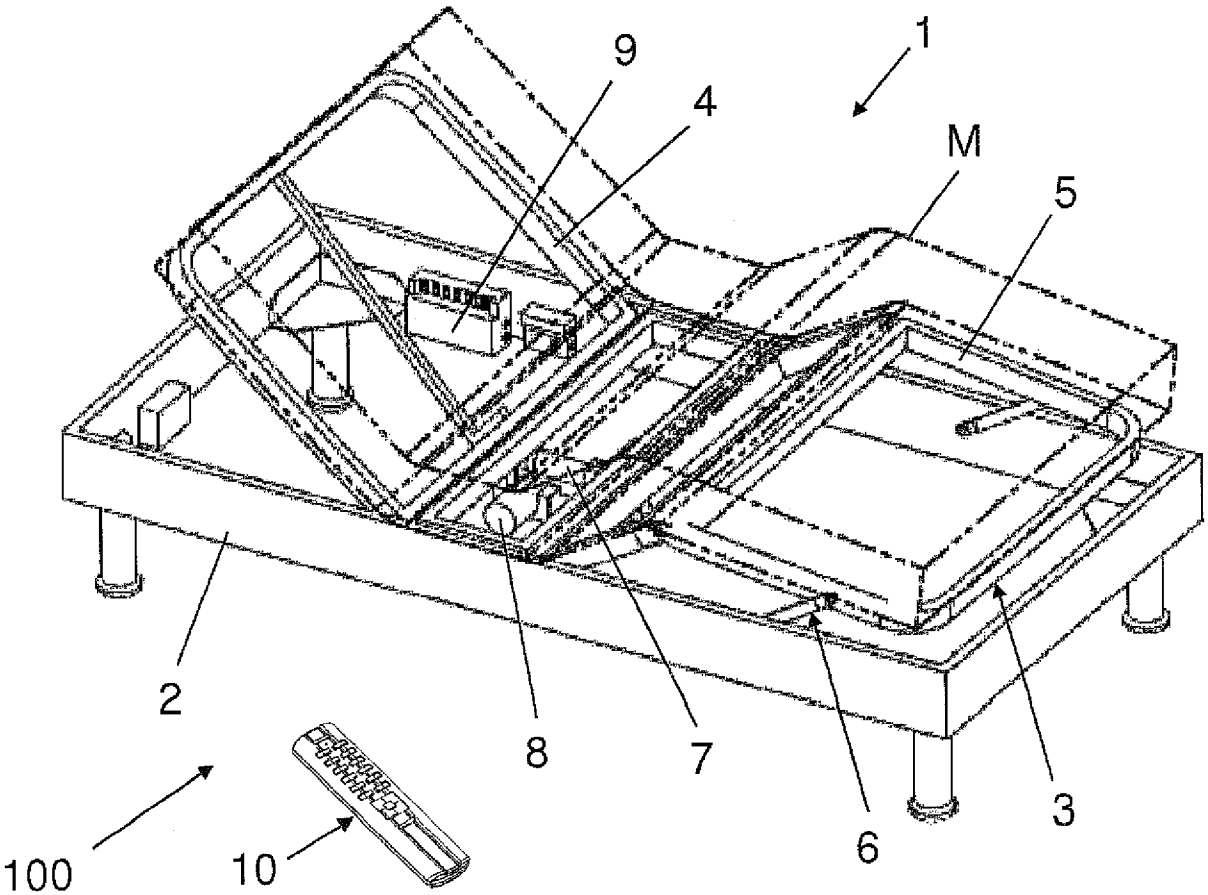
FIG. 1 shows a schematic perspective view of an exemplary piece of furniture in accordance with the invention.
Figure 2:
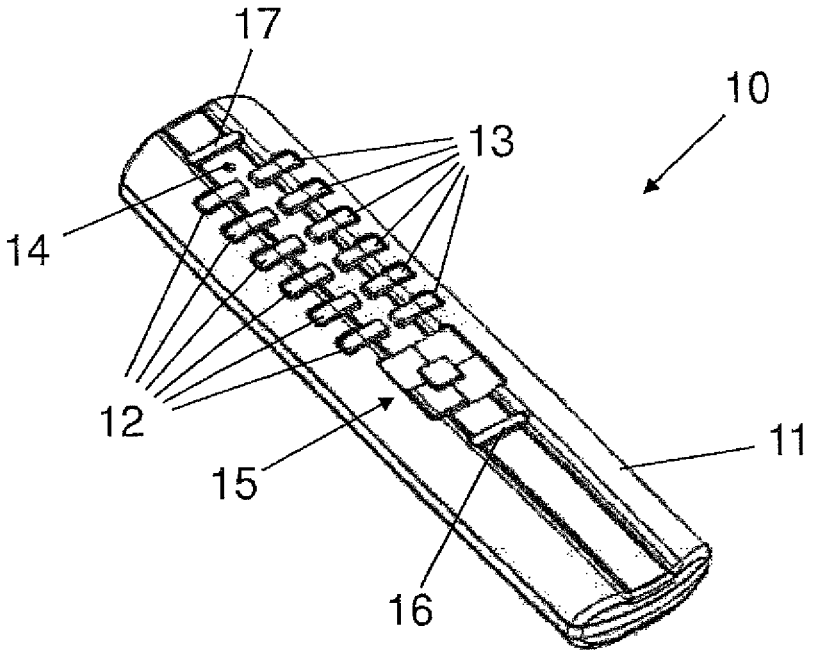
FIGS. 2-2*a* show schematic perspective views of an operating unit.
Figure 2A:
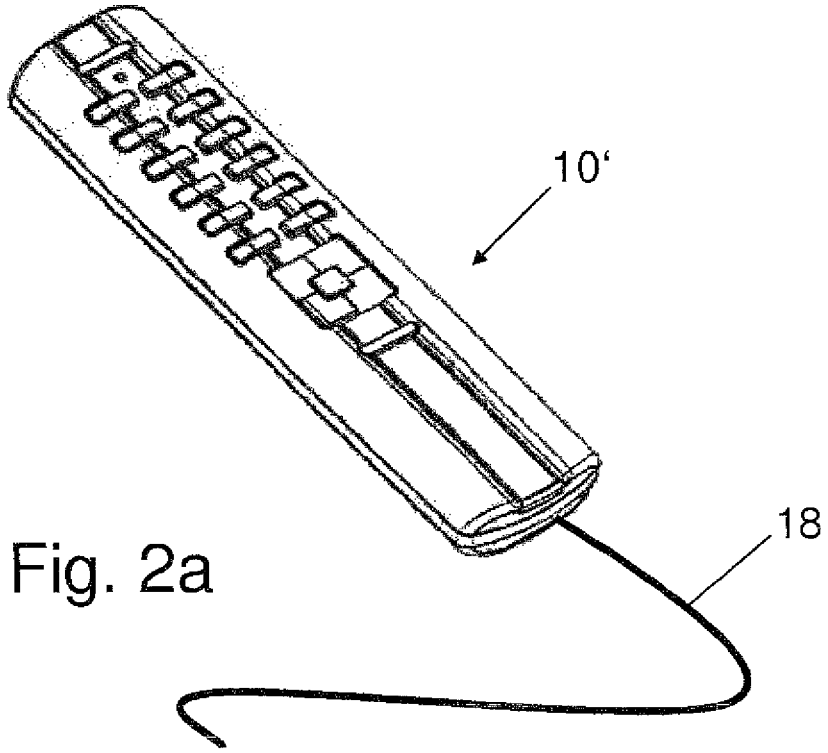
Figure 3:
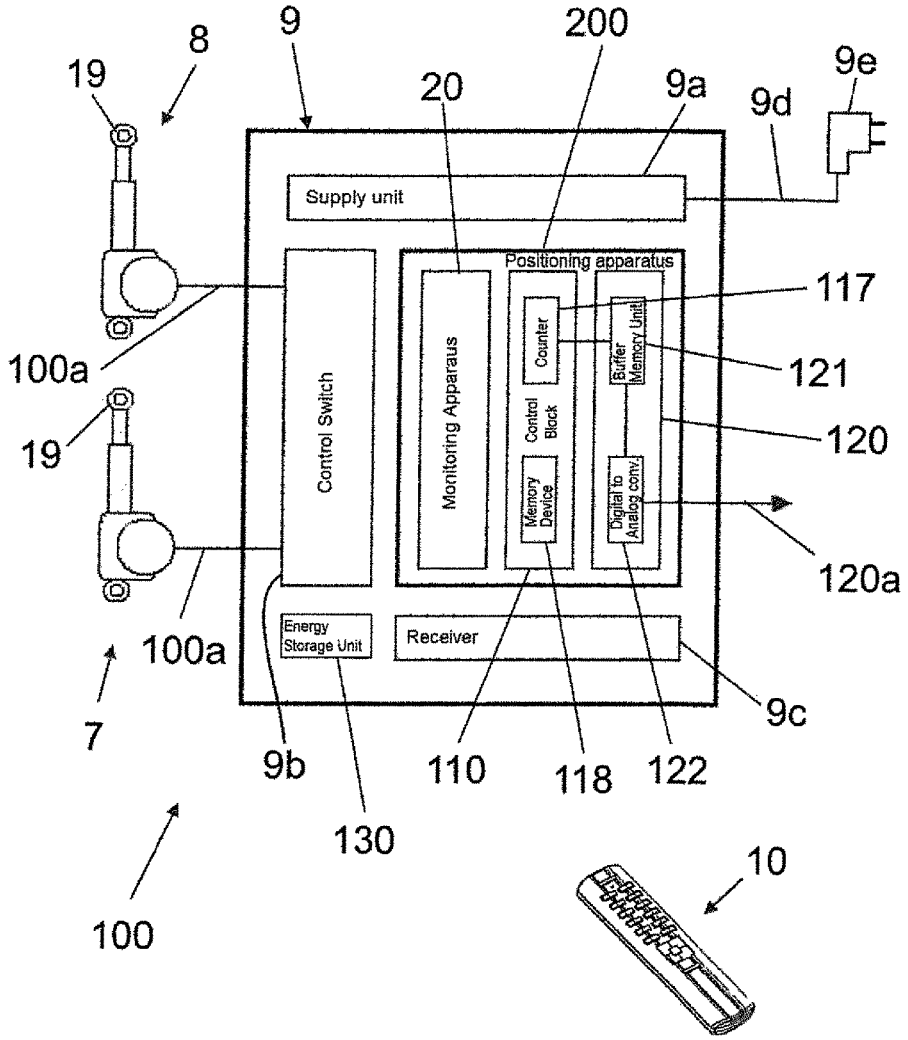
FIG. 3 shows a schematic block diagram of an embodiment of an electromotive furniture drive in accordance with the invention.

FIG. 1 shows an embodiment of a piece of furniture 1 in accordance with the invention. FIGS. 2 and 2*a* show schematic perspective views of an operating unit 10, 10'. FIG. 3 shows a schematic block diagram of an embodiment of an electromotive furniture drive 100 in accordance with the invention.

The piece of furniture 1 is shown as a bed and comprises at least one support element 3 for accommodating items, upholstery, a mattress M and/or a person. The support element 3 is arranged as a slatted base, as a flat support surface or the like for example and is attached to a base element 2, which is a frame with feet in this case, for coupling the piece of furniture 1 to an installation site, e.g. a floor.

The support element 3 comprises a backrest part 4 and a leg part 5, which are arranged in a movably mounted manner relative to the support element 3 and/or a further support element or relative to the base element 2. This movable arrangement is realized in this case by means of a so-called motion fitting 6. The movement is arranged to be displaceable and/or pivotable.

The piece of furniture 1 further comprises an electromotive furniture drive 100, which in this case comprises two adjusting drives 7 and 8, a control device 9 and an operating unit 10.

The movably mounted backrest part 4 and the leg part 5 are respectively coupled to an adjusting drive 7, 8. As a result, the backrest part 4 is coupled to the adjusting drives 7. The adjusting drive 8 is provided for moving or adjusting the leg part 5.

The linear drives 7, 8 are arranged in this case as linear drives. The linear drives comprise one or several electric motors, wherein each motor is provided downstream with a revolution speed reducing gear mechanism with at least one gear step. The speed reducing gear mechanism can be provided downstream with a further gear, e.g. in form of a threaded spindle mechanism, which produces a linear movement of an output element 19 from the rotary movement of the motor (FIG. 3). The last gear element or any further gear element connected thereto forms the output element 19. The output element 19 of the respective adjusting drives is in connection with the respective furniture component (backrest part 4, leg part 5) or alternatively with a component connected to the base frame 2, so that the movable furniture components 4, 5 are adjusted relative to each other or relative to the base frame 2 during operation of the electric motor of the respective adjusting drive 7, 8.

The adjusting drives 7, 8 are connected to a control device 9 via a respective drive line 100*a*, as shown in FIG. 3. Said drive line 100*a* can be arranged as a pluggable cable connection. The control device 9 comprises an electric supply unit 9*a*, which provides electric power, e.g. from the grid, for the adjusting drives 7, 8. For this purpose, the control device 9 is connectable to a mains connection in this example via a mains cable 9*d* with a mains plug 9*e*. The mains plug 9*e* supplies the mains voltage on the input side via the mains cable 9*d* to the electric supply unit 9*a* of the control device 9, which supplies a low voltage in form of a DC voltage on the secondary side and transmits this voltage to a motor control unit with control switches 9*b*.

As an alternative, the control device is provided upstream with a mains-dependent voltage supply with mains input (not shown in closer detail) and with a low voltage output on the secondary side, which supplies a low voltage in form of a DC voltage via the line 9*d*.

The piece of furniture 1 is further associated with an operating unit 10, 10', whose control elements 12, 13 (FIG. 2) control the adjusting drives 7, 8 via the control device 9.

The operating unit 10 according to FIG. 2 is provided with a transmitter device or transmitter/receiver device for wireless transmission. The wireless transmission can be a radio transmission link, an optical transmission link (e.g. infrared) and/or an ultrasonic sound transmission link, wherein the control device 9 is provided with a respective receiver device.

In another embodiment, the operating unit 10' is arranged with an operating line 18 in a wire-bound form, which is shown in FIG. 2*a*. The operating line 18 can be connected to the control device 9, e.g. by a plug-in connection.

The operating unit 10, 10' is provided with operating elements 12, 13, which are provided for operating a respective adjusting drive 7, 8. The operating elements 12, 13 are arranged as pushbuttons for example. The operating elements 12 are used for moving the respectively movable furniture part in an upward direction for example and the operating elements 13 for lowering the respectively movable furniture part. FIGS. 2 and 2*a* show the operating units 10, 10' for six adjusting drives.

The operating unit 10, 10' is further provided with an indicator element 14, e.g. a light-emitting diode. The indicator element 14 is used for displaying functionality, feedback, error display etc.

An additional operating element 15, which can also consist of several operating elements and/or a combination operating element, is used for a so-called memory function of the adjusting drives 7, 8.

Furthermore, additional functions such as a reading lamp and/or heating can be controlled by means of further additional operating elements 16, 17.

The additional operating elements 15, 16, 17 can be arranged as pushbuttons and/or switches.

When an operating element 12, 13 is actuated, a control signal is transmitted for triggering the respective adjusting drive 7, 8 via the transmission link in a wireless or wired-bound fashion to the control device 9. The control device 9 comprises a control switch 9*b* with switching elements which convert the control signals of the transmission link into switching signals for switching the respective adjusting drive 7, 8. The switching elements can be relay switches and/or semiconductor switches for example. The operating elements 12, 13 of the operating unit 10, which can be actuated manually, generate control signals which are converted in this case by a receiver 9*c* of the control device 9 into control currents for the switching elements. In the case of the wire-bound operating unit 10', the operating elements 12, 13 switch the control current of the relay switches or semiconductor switches. In both cases, the power switches of the relay switches or the semiconductor switches switch the high motor current of the respective adjusting drive 7, 8.

The adjusting drives 7, 8 are arranged as commutator DC motors or comprise such motors.

The control device 9 of the electromotive furniture drive 100 further comprises a positioning apparatus 200 for positioning the respective output element 19 of the respective adjusting drive 7, 8. The positioning apparatus 200 is equipped with an adjuster block 110 which has a counter 117 and a memory device 118.

A back-EMF of the respective motor M1 is detected for so-called memory control and/or synchronous control for several adjusting drives 7, 8, wherein an evaluation of so-called ripples of the back-EMF is carried out.

In contrast to the positioning apparatus of DE 10 2009 059 267 A1 mentioned above, the electromotive furniture drive 100 in accordance with the invention additionally comprises a monitoring apparatus 20 for monitoring a pulse-with ratio of the ripples of the detected back-EMF of the motor M1, and furthermore and in addition a digital potentiometer 120. The monitoring apparatus 20 will be described below in closer detail.

The digital potentiometer 120 comprises at least one buffer memory unit 121 and at least one digital-to-analog converter 122. The buffer memory unit 121, which is arranged as a rewritable volatile or non-volatile memory, is connected to the counter 117 of the control block 110 and is provided for the buffer memory of counts of the counter 117. The digital-to-analog converter 122 converts the count, which is intermediately stored in the buffer memory unit 121, into an analog output value and makes it available in an analog output.

The analog output value is a voltage value and/or a current value for example. It can lie for example within a predetermined voltage or current interval. A minimum value corresponds to a first end position state of the output element 19 and a maximum value to a second end position state of the output element 19. As a result, this interval can reach from 0 V to 5 V for example, wherein 0 V corresponds to a first end position state of the output element 19 and 5 V to a second end position state of the output element 19. This simulates a potentiometer which is coupled to the output element 19 of the respective adjusting drive 7, 8.

Furthermore, the control device 9 comprises an energy storage unit 130. The energy storage unit is preferably a rechargeable battery or a capacitor of high capacitance. A storage capacity of the energy storage unit 130 is arranged in such a way that the part of the electric circuit for detecting, evaluating and counting the ripples of the positioning apparatus 200 can be operated in the currentless state at least for a specific time interval by means of the energy storage unit 130.

Figure 4:
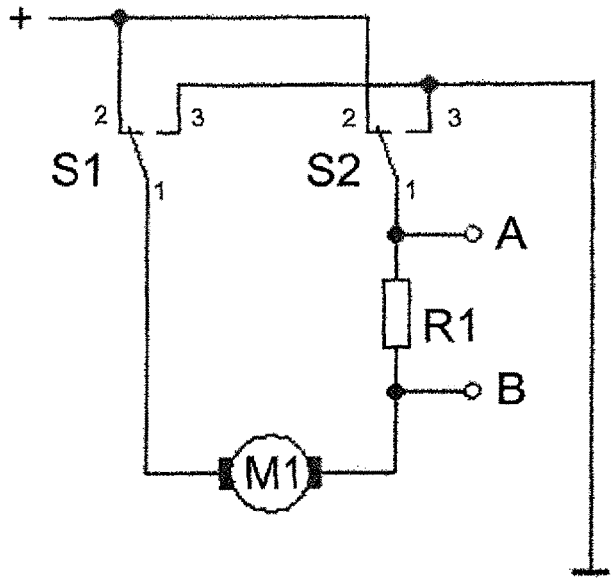
FIGS. 4-4*a* show schematic circuit diagrams of switching contact configurations.
Figure 4A:
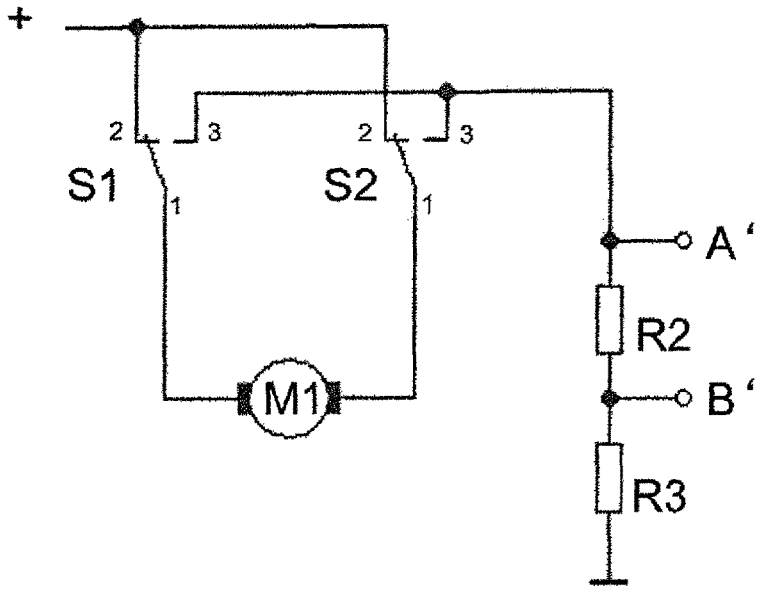

FIGS. 4 and 4*a* show schematic circuit diagrams of switching contact configurations.

In FIG. 4, the motor M1 is connected via a first connecting line to a connection 1 of a changeover contact S1. The second connecting line of the motor M1 is connected via a resistor R1 to a connection 1 of a second changeover contact S2. The changeover contacts S1 and S2 are switching contacts of a respective relay for example.

In another embodiment (not shown in closer detail) the operating unit 10 comprises at least two changeover contacts S1 and S2, which are actuated by the operating elements 12, 13.

FIG. 4 shows the motor M1 in the deactivated state. Break contact connections 2 of the changeover contacts S1 and S2 are connected to each other and to a positive line of the supply unit (not shown) of the control device 9. Make contact connections 3 of the changeover contacts S1 and S2 are also connected to each other and to a negative/ground line of the supply unit (not shown) of the control device 9. FIG. 4 shows the deactivated state of the motor M1. In this case, the motor M1 is short-circuited via the break contacts 2 of the changeover contact S1 and S2 and the resistor R1. This state is also known as rheostatic braking.

For the purpose of detecting the back-EMF of the motor M1, a voltage, which drops at the resistor R1 as a result of the motor current flowing through the resistor R1 during the operation of the motor M1, is measured at the connections A and B of the resistor R1.

In the configuration according to FIG. 4, a detection of the motor current is also possible when the motor M1 is short-circuited, which motor current is generated by twisting the motor shaft of the motor M1 due to high load despite the short-circuit. Such twisting can occur for example when automatic locking of the mechanical gear interposed between the motor shaft and force introduction is overcome by introduction of high forces. It is also possible that a braking apparatus still permits a twisting of the motor shaft in the case of an unexpected overload torque. Such cases can be detected here and respective countermeasures can be initiated.

In an alternative embodiment as shown by FIG. 4*a*, a detection of the back-EMF of the motor M1 can also occur in the power supply line. In this case, a resistor R2 is arranged in the negative/ground line to the make contact connections 3 of the changeover contacts S1 and S2. The motor lines of the motor M1 are connected in this case directly to the connections 1 of the changeover contacts S1, S2. The back-EMF of the motor M1 can be detected at the connections A' and B' of the resistor R2 depending on its motor current. In this case, only one motor can be displaced when the resistor R2 is disposed in a common supply line for all motors.

The further resistor R3 in the negative/ground line fulfills further functions for specific embodiments, which will be explained below in closer detail.

For the purpose of a so-called soft starting function, said resistor R3 can be switched into the line. This occurs in such a way for example that the resistor R3 can be bridged by a contact. This bridging is opened during soft starting, so that the motor current must flow through the resistor R3. After a respective start-up period, the bridge is closed again and the resistor R3 is bridged for normal operation of the motor M1.

It is alternatively or additionally possible to switch several resistors in series or in parallel, wherein they are bridged in a respectively automatic way, e.g. via relay contacts or semiconductor switches. The resistor R3 can also be an NTC with additional bridging.

It is also possible to use an adjustable resistor such as a transistor instead of the resistor R3. The resistor can be controlled to a higher or lesser extent via a ramp function. The ramp function is current-controlled and/or temperature-controlled. A high current leads to a short-term ramp.

The resistors R2 and R3 can also be arranged alternatively in an embodiment or combination, so that two functions (e.g. soft starting and detection of the back-EMF) can occur with one resistor. After soft starting, bridging occurs in such a way that a residual resistance remains via which the back-EMF can drop for detection.

By using the resistor R3 and the aforementioned alternatives or supplements, an important advantage is provided as compared to PWM triggering of the motor M1 for maintaining soft starting in connection with the evaluation of the back-EMF. PWM triggering would disturb the evaluation of the so-called ripple of the back-EMF.

Furthermore, soft starting can also be understood as the initially described throttling, because at the time of the activation of the electric motor and simultaneously for the movement of high loads the pulse-width ratio can be in the critical range, which impairs the evaluation and counting of the ripples. The soft starting or throttling acts like a resistor in accordance with the invention. In the simplest of cases, a resistor is used as described above. Another resistor further comprises an imaginary part and may also comprise an inductance or a capacitance. As a result, the resistor R3 can also be an inductance or comprise an inductance.

The evaluation of the back-EMF is carried out in an analogous and discrete manner via filters, and occurs after digitization by means of a microprocessor which is present in the control device 9 and is provided with a respectively high scanning rate.

Figure 5:
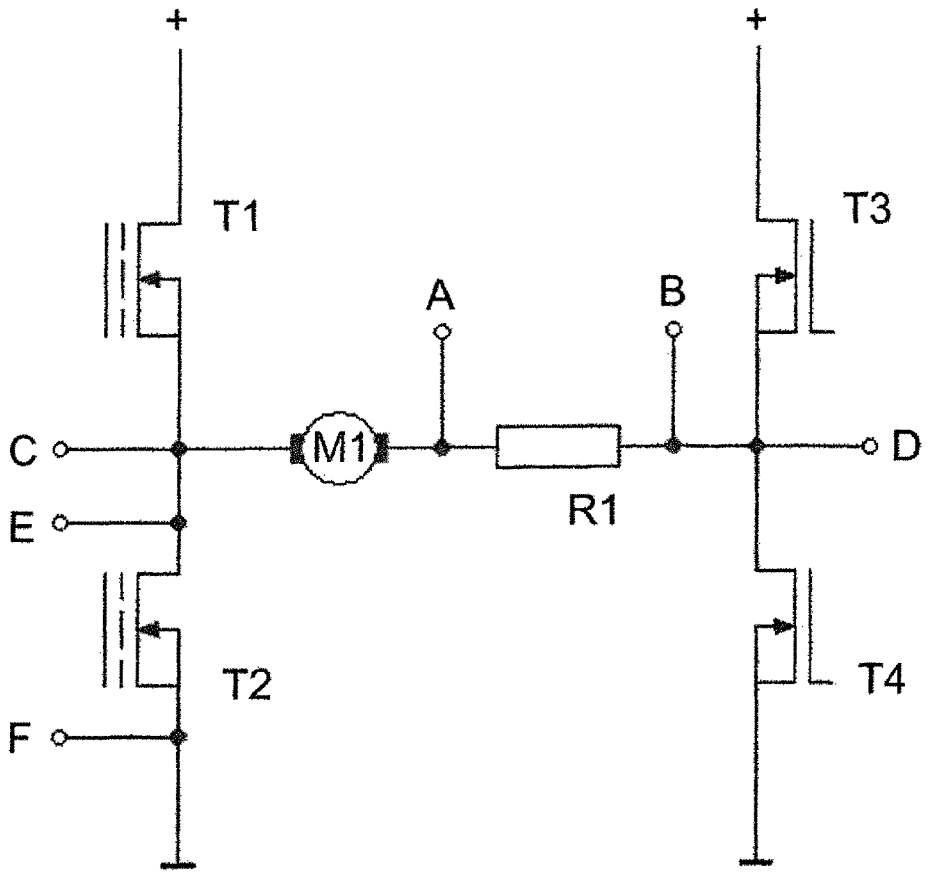
FIG. 5 shows a schematic circuit diagram of an H-bridge circuit.

The motor M1 of every adjusting drive 7, 8 can also be switched in and controlled by means of semiconductor switches. FIG. 5 shows a schematic circuit diagram of a so-called H-bridge circuit.

The motor M1 is connected in the bridge arm between two respective transistors T1, T2 and T3, T4 which are respectively switched in series. A resistor R1 is switched in series with the motor M1 in this case. The transistors T1 . . . T4 can be arranged as MOS-FET, wherein they are partly conductive or non-conductive in the idle state.

Several possibilities for detecting the back-EMF of the motor M1 are shown, which are indicated below briefly in form of a table.

TABLE 1

| Measuring points | | |
|---|---|---|
| No. | Connection 1 | Connection 2 |
| 1 | A | B |
| 2 | C | Ground |
| 3 | D | Ground |
| 4 | C | D |
| 5 | E | F |
| 6 | C | Positive pole |
| 7 | D | Positive pole |

Preferably, measurement according to No. 1 occurs at the connections A and B via a resistor R1 because it is thus also possible to detect a rotation of the motor M1 in the short-circuited state.

A measurement according to No. 4 allows the detection of fluctuations of the collector current.

Since the transistors T1 . . . T4 respectively have specific resistance in the conductive state, a measurement can occur for example via the transistor T2 according to No. 5 (and obviously also via any other of the transistors T1 . . . T4). The specific resistance of the respective transistors T1 . . . T4 can thus be utilized in the simplest possible way.

In the deactivated state of the motor M1, in which the motor M1 is to be short-circuited for producing the rheostatic brake, the transistors T2 and T4 are switched in this example in a conductive manner to ground.

Figure 6:
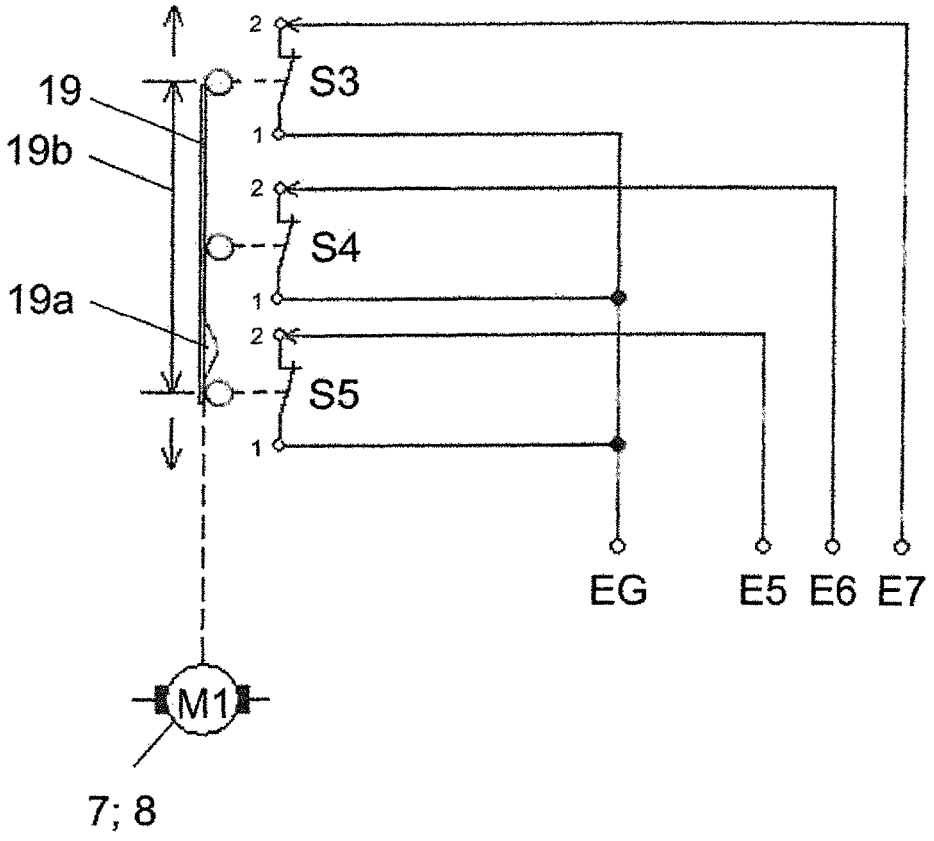
FIG. 6 shows a schematic block diagram of an adjusting drive with an output element and end switches or with reference switches.

FIG. 6 shows a schematic block diagram of an adjusting drive 7, 8 with an output element 19 and end switches S3, S4, S5. The output element 19 is adjustable by the adjusting drive 7, 8 along an adjusting path 19*b* in the direction of the arrows. When the end positions are reached, a cam 19*a* cooperates with an end switch S3 or S5. The invention differs from the document DE 10 2009 059 267 A1 mentioned above Differences in relation to this document will be described below.

The first difference is that there is no opening of the motor current circuit of the adjusting drives 7, 8 when one of the end switches S3 or S5 are actuated in the associated end positions of the output element 19. Instead, the power supply is deactivated, the motor M1 is short-circuited and a reference point for the control or positioning of the output element 19 is newly set.

The end switches S3 and S5 are included in a control circuit of a transistor T1 . . . T4 or a changeover contact S1, S2 in a manner not shown in closer detail. In an alternative embodiment also not shown in closer detail, the end switches S3 and S5 are arranged as changeover contacts, interrupt the motor current upon actuation by a switching cam and short-circuit the motor upon changeover of the contact, so that the rheostatic braking properties of the motor are activated.

The second difference is formed by at least one third end switch S4, which is arranged within an adjusting path 19*a* at a position that is determined previously, e.g. in the middle. If this at least one third end switch S4 is actuated by the cam 19*b* during the adjustment of the output element 19, the reference point for the control or positioning of the output element 19 is newly set accordingly.

In other words, the end switches S3 and S5 deactivate the motor M1 by cutting off the power supply, short-circuit the motor and newly set the reference point. The end switch S3 only newly sets the reference point. This reduces the error rate in the positioning of the output element 19.

In this example shown in FIG. 6, the end switches S3, S4 and S5 are provided with break contacts, wherein the connections 1 of the break contacts are connected to each other and to a common end switch connection EG. The respective connections 2 of the break contacts of the end switches S3, S4 and S5 are respectively separately connected to an end switch connection E5, E6, E7. The end switch connections EG, E5, E6, E7 are connected to the control device 9.

It was also noticed that during the evaluation of the back-EMF the occurrence of the pulses or ripples to be counted can be problematic when there is a high load on the respective adjusting drive 7, 8. This can be caused by various facts, but the effects on the ripple are that the pulse-width ratio of the ripple changes after filtering on the one hand and the amplitudes of the ripples decrease on the other hand. In this process, it is either no longer possible to count any ripples anymore or too many ripples are counted. In-depth examinations have shown that a specific pulse-width ratio (e.g. 10/90) forms a critical point.

Figure 7:
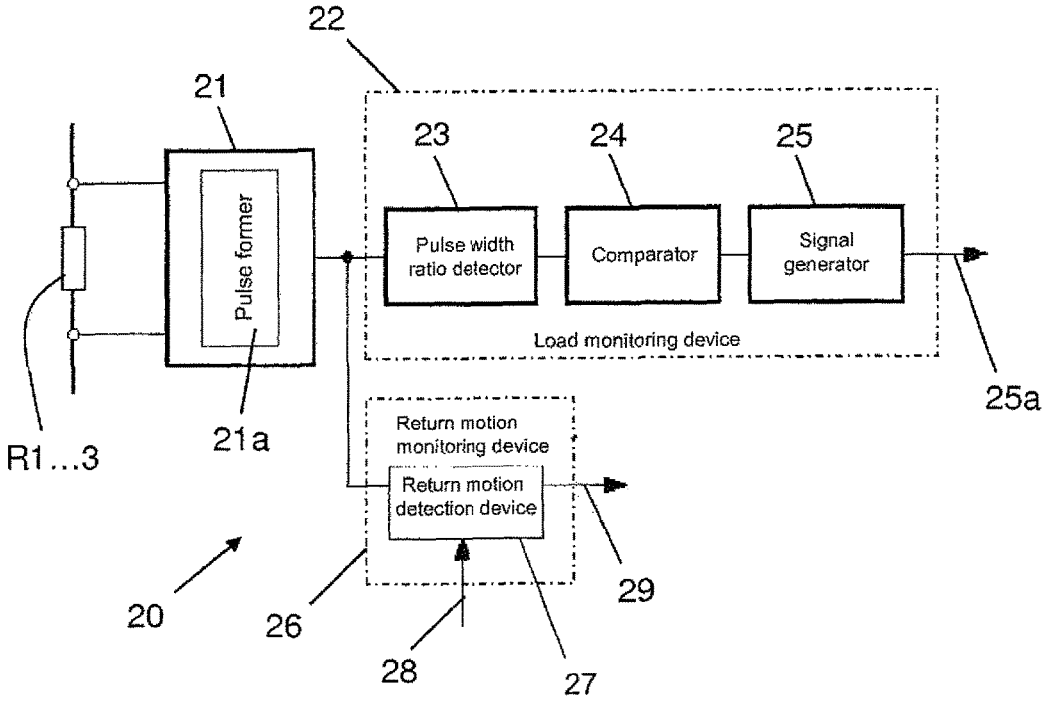
FIG. 7 shows a schematic block diagram of a monitoring apparatus in accordance with the invention.

FIG. 7 represents a schematic block diagram of a monitoring apparatus 20 in accordance with the invention.

The monitoring apparatus 20 comprises a filter unit 21 with a pulse former 21*a* and a load monitoring device 22 with a pulse-width ratio detector 23, a comparator 24 and a signal generator 25.

The filter unit 21 comprises two filters. The back-EMF of the respective mode M1 is measured (as already explained above) via a resistor R1, R2 and/or R3 as a voltage drop at connections of said resistor as a result of the flowing motor current and is supplied to the filter unit 21. The filter unit 21 preferably comprises two filters.

The output signals of the filter unit 21 are formed into square-wave signals by the pulse former 21*a* in this case. In the case of an overload of the associated motor M1, the pulse-width ratio of the square-wave signal decreases substantially, wherein the frequency also decreases because the speed of the motor M1 decreases. Furthermore, a signal similar to a square wave or a slightly distorted square-wave signal can be obtained, which can be evaluated as a square-wave signal however.

The pulse-width ratio detector 23 detects the pulse-width ratio of the thus formed square-wave signal and supplies it to the comparator 24, which compares it with a previously determinable value such as the critical value 10/90. Once the detected pulse-width ratio falls beneath or exceeds the previously determinable value in this comparison, this is signaled to the signal generator 25 in a respective manner.

The signal generator 25 then generates respective output signals, which it provides to an output 25*a* for further processing for the associated motor M1.

The further processing of these produced output signals occurs by the control device 9, which occurs in such a way that action is performed in a throttling manner on the power supply of the associated motor M1. This is realized in such a way that a PWM control of the motor M1 occurs for throttling or a series resistor is connected in incoming circuit before the motor M1. This can be the aforementioned resistor R3 or the aforementioned inductance with a resistance component R3 with the indicated possibilities for example.

Furthermore, the monitoring apparatus 20 comprises in this example a return-motion monitoring device 26 with a return-motion detection unit 27, which is coupled on the input side to the output of the filter unit 21. As already mentioned above, the motor current can also be detected in the short-circuited state of the motor M1, e.g. according to FIG. 4 for example. For this purpose, the return-motion detection unit 27 is activated by the control device 9 via a control input 28 when the associated motor M1 is in the short-circuited state. When the return-motion section unit 27 then determines a rotation of the motor shaft of the motor M1 as a result of the detected back-EMF, it generates a signal which it sends to an output 29 for further processing, e.g. for registration or warning message. The return-motion detection unit 27 is provided with an amplifier of high amplification in order to detect even small back-EMF amounts.

The monitoring apparatus 20 can be integrated in the positioning apparatus 200 in such a way that it is provided as an additional unit, wherein it comprises its own filter unit 21. The monitoring apparatus 20 can also be coupled to the output of the existing filter of the positioning apparatus 200 in a respective manner, wherein the pulse former 21*a* is added.

Figure 8:
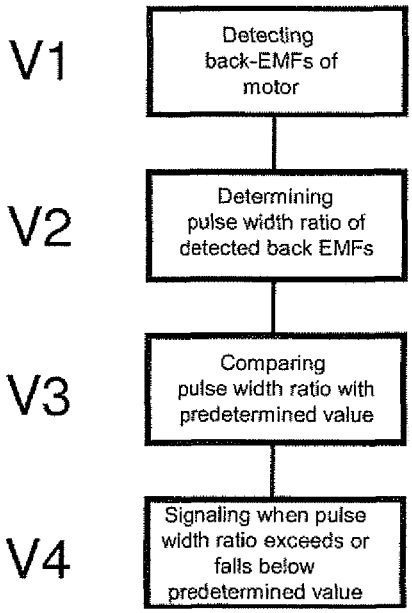
FIG. 8 shows a schematic flowchart of a method in accordance with the invention.

Finally, FIG. 8 shows a schematic flowchart of a method in accordance with the invention for monitoring a pulse-width ratio of an electromotive furniture drive 100.

In a first method step the V1, a back-EMF of the respective motor M1 of the electromotive furniture drive 100 is detected. This occurs by measurement of a voltage drop on a resistor R1, R2, R3 or a specific resistance of a transistor T1, T2, T3, T4. The respective voltage drop is generated by the motor current of the associated motor M1. The occurring pulses or ripples are formed by the pulse former 21*a* into square-wave pulses.

A pulse-width ratio of the ripples thus detected and formed is detected in a second method step V2 by the pulse-width ratio detector 23. The pulse-width detector 23 generates a respective signal which it supplies in a previously determinable form to the comparator 24.

In a further method step V3, the comparator 24 compares the signal supplied to it with a previously determinable value such as the critical value 10/90. This previously determinable value is provided in such a way that it can be compared with the signal supplied by the pulse-width ratio detector 23 in a simple and reliable manner by means of the comparator 24.

Once the detected pulse-width ratio falls below or exceeds the previously determinable value in this comparison with the comparator 24, this is signaled by the comparator 24 in a fourth method step V4 for monitoring the pulse-width ratio of the electromotive furniture drive 100 to the signal generator 25 in a respective manner. The signal generator 25 then generates respective output signals as described above.

A load monitoring system can also recognize a case of jamming or an overload when the frequency of the ripples falls beneath a specific value. This can be performed with the comparator 24.

The invention is not limited to the embodiments as described above. It can be modified within the scope of the enclosed claims.

It is possible for example that the motor M1 is completely deactivated in the case of a critical pulse-width ratio. A documentation of this occurrence can be stored in a memory (not shown) and can be read out subsequently. At the same time, an acoustic/optical/haptic signal can be emitted by respective signaling devices.

Load monitoring by the monitoring apparatus 20 can form a so-called intelligent overcurrent shut-off system of the respective motor M1.

If the ripple frequency drops and if a further parameter changes (e.g. if the motor current rises the voltage drops in the motor) there is a case of jamming or an overload.

Learning travel during first start-up: at least one parameter (the ripple frequency and/or the motor current and/or the motor voltage) is permanently detected over the entire adjusting path 19*b* (FIG. 6). Software writes a table "travel path depending on the parameters". Adjusting ranges with a higher need for power/or ranges with smooth running can thus be detected.

In regular operation of the motor, the table forms a reference value. If the currently determined parameter deviates substantially from the value in the table, there is possibly an overload or a case of jamming.

The table can also be preprogrammed and characteristic for a specific piece of furniture.

Unless described otherwise, all or individual features and functions of an electric or electronic nature as described above can be used in circuits arranged in a discrete fashion. It is further an object of the invention as an alternative or in addition that individual functions and features are arranged as a program or as individual program sections, which cooperate as a calculation process with a computing apparatus in form of a microcontroller for example.

For this purpose, the respective connections A to H, EG, E4 to E7 are connected to an input of the microcontroller. The following can be considered as a program section: according to the initially described pulse-width ratio detector 23 with detection and evaluation of the pulse-width ratio and comparison with a critical value 10/90 in this case as a program section for monitoring a pulse-width ratio and/or as a program section for load monitoring; according to the initially described filter unit 21 in this case as an image of a calculation routine with at least one average value calculation; according to the initially described return-motion monitoring device 26 with a return-motion detection unit 27 in this case now with a calculation routine with further counting of the ripple signals when the motor M1 is deactivated; according to the initially described load monitoring for recognition of a case of jamming or overload in this case now as a calculation routine with a comparison of predetermined memory values; according to the initially described signal generator 25 in this case now as a calibration routine for switching a switching or control output of the microcontroller.

The invention claimed is:

1. An electromotive furniture drive for adjusting a movable part of a piece of furniture, said electromotive furniture drive comprising:

an output element;

at least one adjusting drive including at least one electric motor and a revolution speed reducing gear mechanism coupled to the at least one electric motor, said revolution speed reducing gear mechanism being coupled in driving relationship to the output element to linearly displace and/or rotatably move the output element, wherein the output element, upon reaching a predetermined position, actuates at least one member selected from the group consisting of an end switch, a reference switch, and a switching unit;

at least one control device comprising a positioning apparatus which is configured to position the output element, said positioning apparatus including a control block having a counter and a memory device for evaluating pulses of a back-EMF of the at least one electric motor;

at least one operating unit operatively connected to the at least one control device to operate the at least one adjusting drive; and at least one monitoring apparatus configured to monitor a pulse-width ratio of a detected back-EMF of the at least one electric motor, said at least one monitoring apparatus comprising at least one filter unit with a pulse former and a load monitoring device with a pulse-width ratio detector, a comparator, and a signal generator, said pulse width ratio detector being configured to detect the pulse-width ratio of the detected back-EMF of the at least one electric motor, said comparator comparing the detected pulse width ratio with a predetermined value and causing the signal generator to generate a signal for control of the at feast one electric motor for throttling the at least one electric motor.

2. The electromotive furniture drive of claim 1, wherein the pulse former is a square-wave pulse former.

3. The electromotive furniture drive of claim 1, wherein the comparator is configured to compare the detected pulse-width ratio with a previously determinable value.

4. The electromotive furniture drive of claim 3, wherein the previously determinable value corresponds to a pulse-width ratio of 10/90.

5. The electromotive furniture drive of claim 1, wherein the signal generator is configured to generate a signal for control of the at least one electric motor for throttling the at least one electric motor.

6. The electromotive furniture drive of claim 1, wherein the monitoring apparatus comprises at least one return-motion monitoring device coupled to an output of the filter unit.

7. The electromotive furniture drive of claim 6, wherein the return-motion monitoring device is configured to recognize a rotation of a motor shaft of the at least one electric motor in a short-circuited and deactivated state of the at least one electric motor and for signaling such recognition.

8. The electromotive furniture drive of claim 1, further comprising at least one energy storage unit connected to the monitoring apparatus.

9. The electromotive furniture drive of claim 8, wherein the at least one energy storage unit is a rechargeable battery or a capacitor of high capacitance.

10. The electromotive furniture drive of claim 8, wherein the at least one energy storage unit has a storage capacity sized to operate part of an electric circuit of the positioning apparatus for detecting, evaluating and counting ripples in a currentless state at least for a specific time interval via the energy storage unit.

11. The electromotive furniture drive of claim 1, wherein the control device comprises a digital potentiometer configured to output an electric value as an output value which is proportional to a position of the output element.

12. The electromotive furniture drive of claim 11, wherein the digital potentiometer comprises at least one buffer memory unit provided for intermediate storage of counts of the counter, and at least one digital-to-analog converter configured to convert a count which is intermediately stored in the buffer memory unit into an analog output value.

13. The electromotive furniture drive of claim 12, wherein the analog output value converted by the digital-to-analog converter is a voltage value and/or a current value.

14. The electromotive furniture drive of claim 12, wherein the analog output value converted by the digital-to-analog converter lies within a predetermined voltage or current interval, wherein a minimum value corresponds to a first end position state of the output element and a maximum value corresponds to a second end position state of the output element.

15. The electromotive furniture drive of claim 12, wherein the buffer memory unit is configured as a rewritable volatile or non-volatile memory.

16. The electromotive furniture drive of claim 1, wherein at least one end switch, upon actuation in an end position of the output element, is provided for controlling an interruption in a power supply to the at least one electric motor, for controlling a short-circuiting of the at least one electric motor and for controlling a new setting of a reference point for control or positioning of the output element.

17. The electromotive furniture drive of claim 1, wherein at least one end switch is arranged at a previously determined location and is provided for controlling a new setting of a reference point for control or positioning of the output element.

18. The electromotive furniture drive of claim 1, wherein the at least one electric motor is configured for soft start-up with at least one bridgeable series resistor.

19. A method for monitoring a pulse-width ratio of an electromotive furniture drive, comprising the steps of:

detecting pulses of a back-EMF of at least one electric motor of the electromotive furniture drive by measuring a voltage drop in a resistor or a specific resistance of a transistor;

detecting a pulse-width ratio of ripples of the detected back-EMF of the at least one electric motor;

comparing the detected pulse-width ratio with a previously determinable value; and monitoring the detected pulse-width ratio by evaluating the comparing step.

20. The method of claim 19, further comprising converting the detected pulses of the back-EMF of the at least one electric motor into square-wave pulses.

21. The method of claim 19, wherein the previously determinable value for the comparing step corresponds to a pulse-width ratio of 10/90.

22. The method of claim 19, wherein the monitoring step includes a throttling of the at least one electric motor in operation, when a value drops below a critical comparative value.

23. The method of claim 19, wherein the comparing step includes monitoring a frequency of the ripples, and the monitoring step includes generating a signal in the presence of a jamming or an overload.

24. A piece of furniture, comprising:

at least one base element configured to couple the piece of furniture to an installation site, at least one support element having a part which is movably arranged relative to the support element or relative to a further support element or relative to the at least one base element, said at least one movably arranged part being constructed to be displaceable and/or pivotable, and at least one electromechanical furniture drive coupled to the at least one movably arranged part and comprising an output element, at least one adjusting drive including at least one electric motor, and a revolution speed reducing gear mechanism coupled to the at least one electric motor, said revolution speed reducing gear mechanism being coupled in driving relationship to the output element to linearly displace and/or rotatably move the output element, wherein the output element, upon reaching a predetermined position, actuates at least one member selected from the group consisting of an end switch, a reference switch, and a switching unit, at least one control device comprising a positioning apparatus which is configured to position the output element and includes a control block having a counter and a memory device for evaluating pulses of a back-EMF of the at least one electric motor, at least one operating unit operatively connected to the at least one control device to operate the at least one adjusting drive, and at least one monitoring apparatus configured to monitor a pulse-width ratio of a detected back-EMF of the at least one electric motor, said at least one monitoring apparatus comprising at least one filter unit with a pulse former and a load monitoring device with a pulse-width ratio detector, a comparator, and a signal generator, said pulse width ratio detector being configured to detect the pulse-width ratio of the detected back-EMF of the at least one electric motor, said comparator comparing the detected pulse width ratio with a predetermined value and causing the signal generator to generate a signal for control of the at least one electric motor for throttling the at least one electric motor.

25. The piece of furniture of claim 24, wherein the control device comprises a memory control unit.

26. The piece of furniture of claim 24, further comprising at least two of said electromotive furniture drive, wherein the control device comprises a synchronous control unit, with adjusting speeds of the at least two electromotive furniture drives being adjusted with respect to each other.

27. The piece of furniture of claim 26, wherein the adjusting speeds of the at least two electromotive furniture drives are put equally with respect to each other.

* * * * *